US006062618A

United States Patent [19]

Figueroa

[11] Patent Number: 6,062,618

[45] Date of Patent: May 16, 2000

[54] POOPER SCOOPER SYSTEM

[75] Inventor: Pedro Figueroa, San Francisco, Calif.

[73] Assignee: Floretta Figueroa, San Francisco, Calif.; a part interest

[21] Appl. No.: 09/276,101

[22] Filed: Mar. 25, 1999

[51] Int. Cl.[7] ..... A01K 29/00; E01H 1/12

[52] U.S. Cl. ..... 294/1.4

[58] Field of Search ..... 294/1.3–1.5, 19.1, 294/2, 50.8, 115, 116, 118, 119; 15/104.8, 257.1, 257.2, 257.4, 257.6

[56] References Cited

U.S. PATENT DOCUMENTS

| | | | |
|---|---|---|---|
| 2,961,674 | 11/1960 | Hunt | 294/22 X |
| 3,139,299 | 6/1964 | Bowen | 294/1.4 |
| 3,446,525 | 5/1969 | Jones | 294/1.4 |
| 4,225,174 | 9/1980 | Hennessy et al. | 294/1.4 |
| 4,383,710 | 5/1983 | Fehr | 294/1.4 |
| 5,350,208 | 9/1994 | Heinrichson | 294/1.4 |

FOREIGN PATENT DOCUMENTS

| | | | |
|---|---|---|---|
| 2457526 | 6/1976 | Germany | 294/1.4 |

*Primary Examiner*—Johnny D. Cherry

[57] ABSTRACT

A pooper scooper system for collecting pet feces from grass and pavement areas. The inventive device includes an elongated pole having a channel extending interiorly thereof. The channel opens into an enlarged chamber at a lower end of the pole. The enlarged chamber has an open lower end exiting the lower end of the pole. An upper end of the pole has a handle integrally formed therewith in an angular relationship with respect thereto. The pole has an opening at the upper end thereof leading into the channel at its uppermost extent. A trigger mechanism is slidably coupled with respect to the elongated pole. The trigger mechanism includes a trigger slidably disposed within the opening at the upper end of the pole. An elongated rod is slidably positioned within the channel. The rod has an upper end secured to the trigger. A pair of pivoting arms are pivotally coupled with respect to the elongated pole and the trigger mechanism.

5 Claims, 2 Drawing Sheets

POOPER SCOOPER SYSTEM

BACKGROUND OF THE INVENTION

1. Field of the Invention

The present invention relates to pet dung disposers and more particularly pertains to a new pooper scooper system for collecting pet feces from grass and pavement areas.

2. Description of the Prior Art

The use of pet dung disposers is known in the prior art. More specifically, pet dung disposers heretofore devised and utilized are known to consist basically of familiar, expected and obvious structural configurations, notwithstanding the myriad of designs encompassed by the crowded prior art which have been developed for the fulfillment of countless objectives and requirements.

Known prior art pet dung disposers include U.S. Pat. No. 4,878,703 to Yoshioka; U.S. Pat. No. Des. 334,255 to Nelson; U.S. Pat. No. 4,865,371 to Egberg; U.S. Pat. No. 4,272,116 to Tufte, Jr.; U.S. Pat. No. 4,186,955 to Campbell; and U.S. Pat. No. 3,901,545 to Shott.

While these devices fulfill their respective, particular objectives and requirements, the aforementioned patents do not disclose a new pooper scooper system. The inventive device includes an elongated pole having a channel extending interiorly thereof. The channel opens into an enlarged chamber at a lower end of the pole. The enlarged chamber has an open lower end exiting the lower end of the pole. An upper end of the pole has a handle integrally formed therewith in an angular relationship with respect thereto. The pole has an opening at the upper end thereof leading into the channel at its uppermost extent. A trigger mechanism is slidably coupled with respect to the elongated pole. The trigger mechanism includes a trigger slidably disposed within the opening at the upper end of the pole. An elongated rod is slidably positioned within the channel. The rod has an upper end secured to the trigger. A pair of pivoting arms are pivotally coupled with respect to the elongated pole and the trigger mechanism.

In these respects, the pooper scooper system according to the present invention substantially departs from the conventional concepts and designs of the prior art, and in so doing provides an apparatus primarily developed for the purpose of collecting pet feces from grass and pavement areas.

SUMMARY OF THE INVENTION

In view of the foregoing disadvantages inherent in the known types of pet dung disposers now present in the prior art, the present invention provides a new pooper scooper system construction wherein the same can be utilized for collecting ret feces from grass and pavement areas.

The general purpose of the present invention, which will be described subsequently in greater detail, is to provide a new pooper scooper system apparatus and method which has many of the advantages of the pet dung disposers mentioned heretofore and many novel features that result in a new pooper scooper system which is not anticipated, rendered obvious, suggested, or even implied by any of the prior art pet dung disposers, either alone or in any combination thereof.

To attain this, the present invention generally comprises an elongated pole having a channel extending interiorly thereof. The channel opens into an enlarged chamber at a lower end of the pole. The enlarged chamber has an open lower end exiting the lower end of the pole. An upper end of the pole has a handle integrally formed therewith in an angular relationship with respect thereto. The pole has an opening at the upper end thereof leading into the channel at its uppermost extent. A trigger mechanism is slidably coupled with respect to the elongated pole. The trigger mechanism includes a trigger slidably disposed within the opening at the upper end of the pole. An elongated rod is slidably positioned within the channel. The rod has an upper end secured to the trigger. A lower end of the rod is positioned within the enlarged chamber. The lower end terminates in a wide retaining ring. The lower end of the rod has a spring disposed thereon. The wide retaining ring has an outer angular segment extending outwardly therefrom. The outer angular segment has a horizontal bar secured to a free end thereof. A pair of pivoting arms or shovels are pivotally coupled with respect to the elongated pole and the trigger mechanism. The pair of pivoting arms include a pair of upper segments having upper ends pivotally coupled with the elongated pole disposed upwardly of its lower end. The pair of upper segments have lower ends extending outwardly in opposed angular directions of opposing sides of the pole. The pair of pivoting arms have intermediate portions disposed in a crossing arrangement. The intermediate portions are pivotally coupled with the pole at their crossing point. Upper ends of the intermediate portions are pivotally coupled with the lower ends of the upper segments. Each of the intermediate portions has an elongated slot therethrough at lower ends thereof. A pin is slidably disposed within each of the slots and couples with opposing ends of the horizontal bar of the trigger mechanism. The pair of pivoting arms have a pair of lower segments extending angulary outward from the intermediate portions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in he following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new pooper scooper system apparatus and method which has many of the advantages of the pet dung disposers mentioned heretofore and many novel features that result in a new pooper scooper system which is not anticipated, rendered obvious, suggested, or even implied by any of the prior art pet dung disposers, either alone or in any combination thereof.

It is another object of the present invention to provide a new pooper scooper system which may be easily and efficiently manufactured and marketed.

It is a further object of the present invention to provide a new pooper scooper system which is of a durable and reliable construction.

An even further object of the present invention is to provide a new pooper scooper system which is susceptible of a low cost of manufacture with regard to both materials and labor, and which accordingly is then susceptible of low prices of sale to the consuming public, thereby making such pooper scooper system economically available to the buying public.

Still yet another object of the present invention is to provide a new pooper scooper system which provides in the apparatuses and methods of the prior art some of the advantages thereof, while simultaneously overcoming some of the disadvantages normally associated therewith.

Still another object of the present invention is to provide a new pooper scooper system for collecting pet feces from grass and pavement areas.

Yet another object of the present invention is to provide a new pooper scooper system which includes an elongated pole having a channel extending interiorly thereof. The channel opens into an enlarged chamber at a lower end of the pole. The enlarged chamber has an open lower end exiting the lower end of the pole. An upper end of the pole has a handle integrally formed therewith in an angular relationship with respect thereto. The pole has an opening at the upper end thereof leading into the channel at its uppermost extent. A trigger mechanism is slidably coupled with respect to the elongated pole. The trigger mechanism includes a trigger slidably disposed within the opening at the upper end of the pole. An elongated rod is slidably positioned within the channel. The rod has an upper end secured to the trigger. A pair of pivoting arms are pivotally coupled with respect to the elongated pole and the trigger mechanism.

Still yet another object of the present invention is to provide a new pooper scooper system that precludes a pet owner from coming into contact with fecal matter.

Even still another object of the present invention is to provide a new pooper scooper system that will help to assure that fecal matter is disposed of properly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
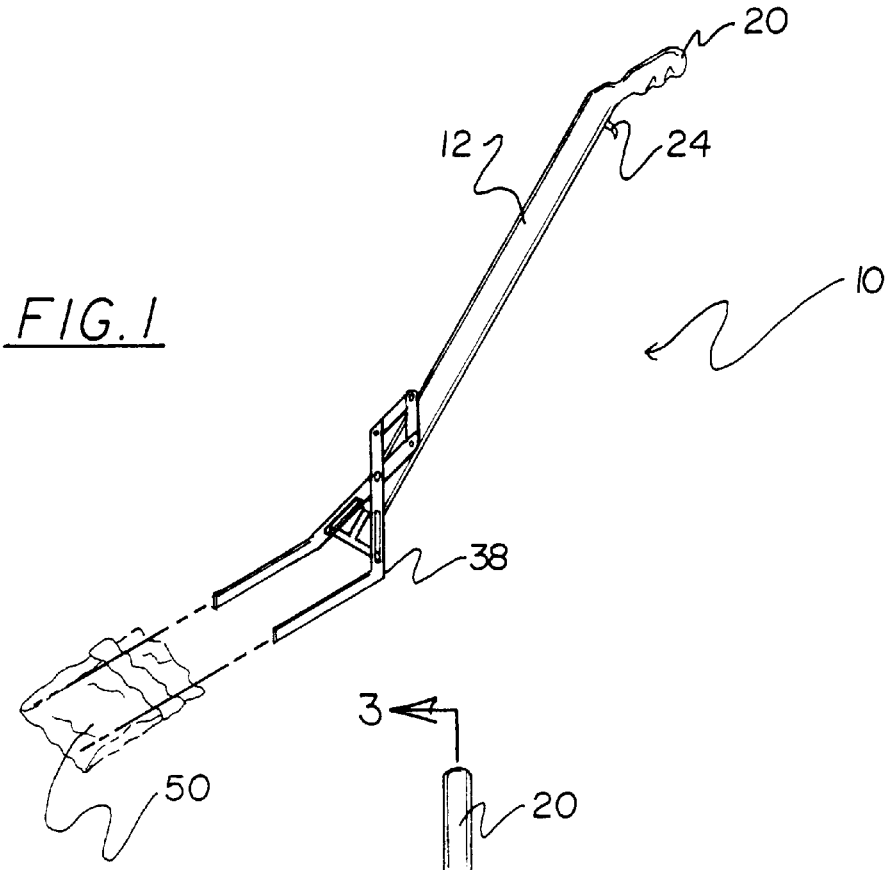
FIG. 1 is a perspective view of a new pooper scooper system according to the present invention.
Figure 2:
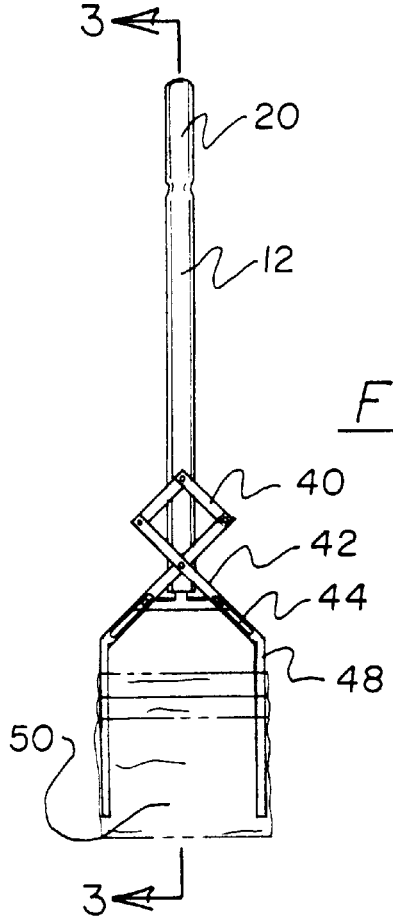
FIG. 2 is a top plan view of the present invention.
Figure 3:
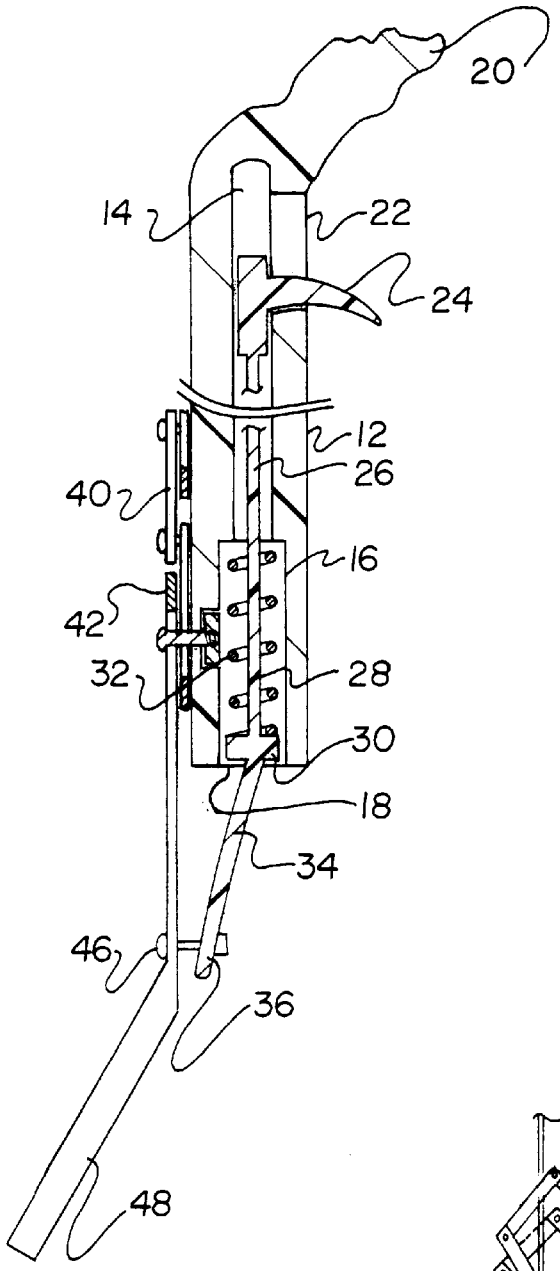
FIG. 3 is a cross-sectional view of the present invention as taken along line 3—3 of FIG. 2.
Figure 4:
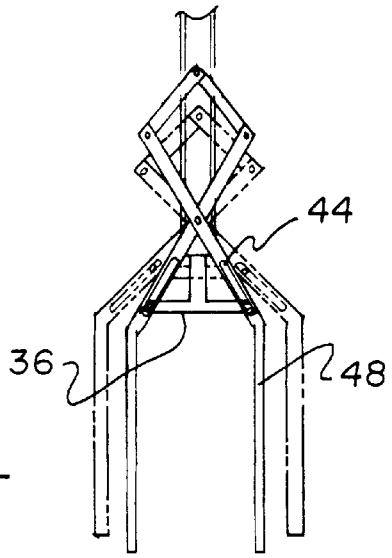
FIG. 4 is a plan view of the present invention illustrating its use.

With reference now to the drawings, and in particular to FIGS. 1 through 4 thereof, a new pooper scooper system embodying the principles and concepts of the present invention and generally designated by the reference numeral 10 will be described.

As best illustrated in FIGS. 1 through 4, the pooper scooper system 10 comprises an elongated pole 12 having a channel 14 extending interiorly thereof. The channel 14 opens into an enlarged chamber 16 at a lower end of the pole 12. The enlarged chamber 16 has an open lower end 18 exiting the lower end of the pole 12. An upper end of the pole 12 has a handle 20 integrally formed therewith in an angular relationship with respect thereto. The pole 12 has an opening 22 at the upper end thereof leading into the channel 14 at its uppermost extent.

A trigger mechanism is slidably coupled with respect to the elongated pole 12. The trigger mechanism includes a trigger 24 slidably disposed within the opening 22 at the upper end of the pole 12. An elongated rod 26 is slidably positioned within the channel 14. The rod 26 has an upper end secured to the trigger 24. A lower end 28 of the rod 26 is positioned within the enlarged chamber 16. The lower end 28 terminates in a wide retaining ring 30. The lower end 28 of the rod 26 has a spring 32 disposed thereon. The wide retaining ring 30 has an outer angular segment 34 extending outwardly therefrom. The outer angular segment 34 has a horizontal bar 36 secured to a free end thereof.

A pair of pivoting arms 38 are pivotally coupled with respect to the elongated pole 12 and the trigger mechanism. The pair of pivoting arms 38 include a pair of upper segments 40 having upper ends pivotally coupled with the elongated pole 12 disposed upwardly of its lower end. The pair of upper segments 40 have lower ends extending outwardly in opposed angular directions of opposing sides of the pole 12. The pair of pivoting arms 38 have intermediate portions 42 disposed in a crossing arrangement. The intermediate portions 42 are pivotally coupled with the pole 12 at their crossing point. Upper ends of the intermediate portions 42 are pivotally coupled with the lower ends of the upper segments 40. Each of the intermediate portions 42 has an elongated slot 44 therethrough at lower ends thereof. A pin 46 is slidably disposed within each of the slots 44 and couples with opposing ends of the horizontal bar 36 of the trigger mechanism. The pair of pivoting arms 38 have a pair of lower segments 48 extending angularly outward from the intermediate portions 42.

In use, a pet owner would place a bag 50 on the lower segments 48 of the pivoting arms 38 and then place the lower segments 48 over the feces. When the trigger 24 is pulled, the spring 32 will be caused to compress and the aims 38 will be pulled towards one another, thus scooping up the feces and closing the bag 50. Alternatively, the pet owner could position the lower segments 48 under the pet prior to it depositing its feces. After use, the pet owner would simply remove the bag 50 from between the pivoting arms 38, and the bag 50 could then be properly discarded in a trash can.

A new clean bag could then be attached to the pivoting arms for the next use.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A pooper scooper system for collecting pet feces from grass and pavement areas comprising, in combination:

an elongated pole having a channel extending interiorly thereof, the channel opening into an enlarged chamber at a lower end of the pole, the enlarged chamber having an open lower end exiting the lower end of the pole, an upper end of the pole having a handle integrally formed therewith in an angular relationship with respect thereto, the pole having an opening at the upper end thereof leading into the channel at its uppermost extent;

a trigger mechanism slidably coupled with respect to the elongated pole, the trigger mechanism including a trigger slidably disposed within the opening at the upper end of the pole, an elongated rod slidably positioned within the channel, the rod having an upper end secured to the trigger, a lower end of the rod positioned within the enlarged chamber, the lower end terminating in a wide retaining ring, the lower end of the rod having a spring disposed thereon, the wide retaining ring having an outer angular segment extending outwardly therefrom, the outer angular segment having a horizontal bar secured to a free end thereof; and a pair of pivoting arms pivotally coupled with respect to the elongated pole and the trigger mechanism, the pair of pivoting arms including a pair of upper segments having upper ends pivotally coupled together, the pair of upper segments having lower ends extending outwardly in opposed angular directions of opposing sides of the pole, the pair of pivoting arms having intermediate portions disposed in a crossing arrangement, the intermediate portions pivotally coupled with the pole at their crossings point, upper ends of the intermediate portions pivotally coupled with the lower ends of the upper segments, each of the intermediate portions having an elongated slot therethrough at lower ends thereof, a pin slidably disposed within each of the slots and coupling with opposing ends of the horizontal bar of the trigger mechanism, the pair of pivoting arms having a pair of lower segments extending angularly outward from the intermediate portions.

2. A pooper scooper system comprising:

an elongated pole having a channel extending interiorly thereof, the channel opening into an enlarged chamber at a lower end of the pole, the enlarged chamber having an open lower end exiting the lower end of the pole, an upper end of the pole having a handle integrally formed therewith in an angular relationship with respect thereto, the pole having an opening at the upper end thereof leading into the channel at its uppermost extent;

a trigger mechanism slidably coupled with respect to the elongated pole, the trigger mechanism including a trigger slidably disposed within the opening at the upper end of the pole, an elongated rod slidably positioned within the channel, the rod having an upper end secured to the trigger, and a pair of pivoting arms pivotally coupled with respect to the elongated pole and the trigger mechanism, each of the pivoting arms having a lower segment extending angularly outward from the pole, the lower segments being oriented substantially parallel to each other, the lower segments having free ends located opposite of the intermediate portions for inserting into a bag, wherein movement of the trigger mechanism produces pivoting of the pivoting arms and varies the spacing between the lower segments while the arms remain in a substantially parallel relationship for stretching the bag when the lower segments are moved away from each other.

3. The pooper scooper system as set forth in claim 2 wherein a lower end of the rod is positioned in the enlarged chamber, the lower end terminating in a wide retaining ring, the lower end of the rod having a spring disposed thereon, the wide retaining ring having an outer angular segment extending outwardly therefrom, the outer angular segment having a horizontal bar secured to a free end thereof for coupling with the pair of pivoting arms.

4. The pooper scooper system is set forth in claim 3 wherein the pair of pivoting arms include a pair of upper segments having upper ends pivotally coupled, the pair of upper segments having lower ends extending outwardly in opposed angular directions of opposing sides of the pole, the pair of pivoting arms having intermediate portions disposed in a crossing arrangement, the intermediate portions pivotally coupled with the pole at their crossing point, upper ends of the intermediate portions pivotally coupled with the lower ends of the upper segments, each of the intermediate portions having an elongated slot therethrough at lower ends thereof, a pin slidably disposed within each of the slots and coupling with opposing ends of the horizontal bar of the trigger mechanism.

5. A feces lifting system for collecting pet feces from a ground surface comprising:

an elongated pole having a channel extending into an interior of the pole, the channel opening into an enlarged chamber at a lower end of the pole, the enlarged chamber having an open lower end exiting the lower end of the pole, an upper end of the pole having a handle integrally formed thereon and extending at an acute angle with respect to the pole, the pole having an opening at the upper end in communication with the channel at its uppermost extent;

a trigger mechanism slidably received in the channel in the elongated pole, the trigger mechanism including a trigger slidably disposed in the opening at the upper end of the pole, an elongated rod slidably positioned in the channel, the rod having an upper end secured to the trigger, a lower end of the rod being positioned in the enlarged chamber, the lower end terminating in a retaining ring, the lower end of the rod having a spring disposed thereon, the retaining ring having an outer angular segment extending outwardly therefrom, the outer angular segment having, a bar secured to a free end of the bar; and a pair of pivoting arms pivotally coupled together, a pair of upper segments having upper ends pivotally coupled together, the pair of upper segments each having a lower end extending outwardly in opposed angular directions on opposite sides of the pole, the lower end of each of the upper segments being pivotally coupled to an upper end of the one of the pivoting arms, the pair of pivoting arms being pivotally coupled at intermediate portions of the arms, the pivoting arms being disposed in a crossing arrangement, the intermediate portions being pivotally mounted to the pole at their crossing point, each of the intermediate portions having an elongated slot therethrough at a lower end of the intermediate portion, a pin being mounted on each of the opposite ends of the bar, each pin being slidably disposed in one of the slots of the intermediate portions for coupling the intermediate portions to the ends of the bar of the trigger mechanism, each of the pair of pivoting arms having a lower segment extending angularly outward from the intermediate portions, the lower segments being oriented substantially parallel to each other, the lower segments having free ends located opposite of the intermediate portions for inserting into a bag, wherein movement of the bar of the trigger mechanism produces pivoting of the pivoting arms and varies the spacing between the lower segments while the arms remain in a substantially parallel relationship for stretching the bag when the lower segments are moved away from each other.

* * * * *